US007950167B2

(12) United States Patent
Nakano

(10) Patent No.: US 7,950,167 B2
(45) **Date of Patent: *May 31, 2011**

(54) ADJUSTABLE FOOTWEAR SOLE CONSTRUCTION

(75) Inventor: Kiyotaka Nakano, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 875 days.

This patent is subject to a terminal disclaimer.

(21) Appl. No.: 11/855,622

(22) Filed: Sep. 14, 2007

(65) Prior Publication Data

US 2008/0289218 A1 Nov. 27, 2008

Related U.S. Application Data

(60) Provisional application No. 60/939,383, filed on May 22, 2007.

(51) Int. Cl.
*A43B 13/18* (2006.01)

(52) U.S. Cl. ..... 36/28; 36/30 R; 36/34 R; 36/37

(58) Field of Classification Search ..... 36/28, 30 R, 36/34 R, 37, 25 R, 100, 39, 27, 29
See application file for complete search history.

(56) References Cited

U.S. PATENT DOCUMENTS

| | | | | |
|---|---|---|---|---|
| 3,377,723 | A | 4/1968 | England | |
| 5,086,574 | A * | 2/1992 | Bacchiocchi | 36/35 R |
| 5,174,049 | A | 12/1992 | Flemming | |
| 5,918,384 | A | 7/1999 | Meschan | |
| 6,205,684 | B1 * | 3/2001 | Snyder | 36/35 R |
| 6,807,753 | B2 * | 10/2004 | Steszyn et al. | 36/28 |
| 6,966,130 | B2 | 11/2005 | Meschan | |
| 6,983,553 | B2 * | 1/2006 | Lussier et al. | 36/28 |
| 7,730,635 | B2 * | 6/2010 | Aveni et al. | 36/27 |
| 7,757,410 | B2 * | 7/2010 | Aveni et al. | 36/28 |
| 2006/0130365 | A1 * | 6/2006 | Sokolowski et al. | 36/35 R |
| 2006/0283046 | A1 * | 12/2006 | Mason | 36/28 |
| 2008/0016718 | A1 * | 1/2008 | Aveni et al. | 36/28 |
| 2010/0192407 | A1 * | 8/2010 | Aveni et al. | 36/28 |

FOREIGN PATENT DOCUMENTS

| | | |
|---|---|---|
| EP | 1733636 | 12/2006 |
| WO | 90/00866 | 2/1990 |
| WO | 2005/053451 | 6/2005 |
| WO | 2006/057978 | 6/2006 |

* cited by examiner

*Primary Examiner* — Ted Kavanaugh
(74) *Attorney, Agent, or Firm* — Warner Norcross & Judd LLP

(57) ABSTRACT

A sole construction having a cushion insert that is installable in the sole at different orientations to vary the support/cushioning characteristics of the sole. The sole construction may include a midsole defining a receptacle configured to receive the cushion insert in a plurality of different orientations. The cushion insert and the receptacle may include a plurality of lobes that are interfitted when the cushion insert is installed in the receptacle. The size, shape and configuration of the lobes may be varied between different regions of the cushion insert so that different regions of the cushion insert provide different support/cushioning characteristics. The cushion insert and the receptacle may be generally disc-shaped so that the sole is adjusted simply by rotating the cushion insert with respect to the receptacle. The lobes may be configured so that rotation of the cushion insert adjusts the sole between supination, pronation, soft and firm settings.

27 Claims, 20 Drawing Sheets

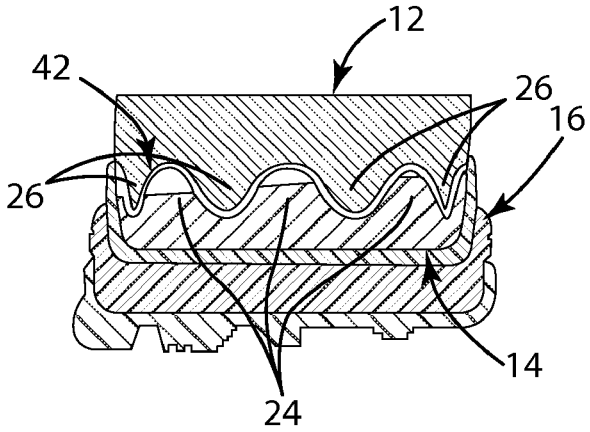
Fig. 4C
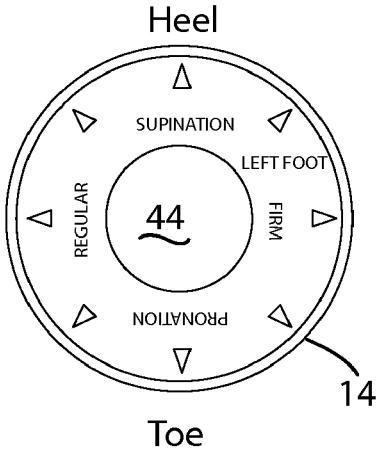
Fig. 9B
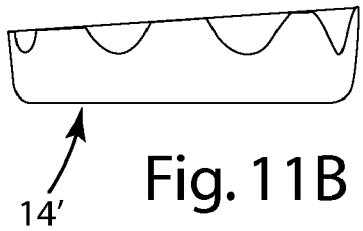
Fig. 11B
Fig. 11A
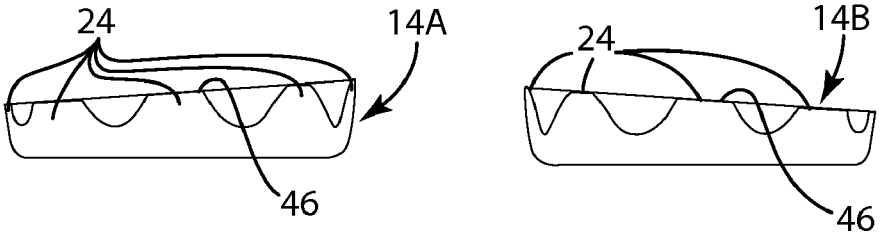

ADJUSTABLE FOOTWEAR SOLE CONSTRUCTION

CROSS-REFERENCE TO RELATED APPLICATIONS

This application claims the benefit of priority under 35 U.S.C. 119(e) of U.S. Provisional Patent Application No. 60/939,383, filed May 22, 2007, which is incorporated herein by reference in its entirety.

BACKGROUND OF THE INVENTION

The present invention relates to footwear soles and more particularly to adjustable footwear sole constructions.

The design and manufacture of footwear is complicated by the fact that different people have different footwear needs. For example, some individuals prefer a firmer, more unyielding sole, while others prefer a softer, more cushioning sole. With some people this is simply an aesthetic desire, but for others it can result from physical factors, such as those associated with foot shape, skeletal alignment and other anatomical issues. Anatomical issues cause some individuals to suffer from a tendency to pronate (roll their feet inward when striding) and others to have the opposite tendency to supinate (roll their feet outward when striding). One method for addressing these issues is to stiffen the sole in select regions to provide increased resistance against the undesired motion. For example, pronation can be addressed by providing a dual-density midsole with a higher density region along the medial side of the sole. Similarly, supination can be addressed by providing a dual-density midsole with a higher density region along the lateral side of the sole In an effort to address the needs of different consumers, a variety of footwear products have been developed with a customizable sole construction. For example, in one conventional product, the sole defines a void adapted to receive one of a variety of different cushioning inserts. With this product, the wearer is provided with different cushioning inserts that meet different cushioning/support needs. The wearer customizes the sole by inserting the appropriate cushioning insert into the void. The insert may be replaced with alternative inserts in the future as desired to alter the characteristics of the sole. Though providing some degree of customization, this solution requires the manufacture and supply of a plurality of inserts. This can increase cost of manufacture and assembly. Further, the consumer is required to save and store the various inserts to permit future adjustment. Additionally, the number of adjustment settings is a function of the number of inserts supplied with the shoe, which has led to relatively limited adjustability in sole constructions of this type.

SUMMARY OF THE INVENTION

The present invention provides a sole with an adjustable cushion insert that can be positioned in the sole in different orientations to provide the sole with different support/cushioning characteristics. In one embodiment, the sole includes a receptacle adapted to receive the cushion insert. In this embodiment, at least one of the receptacle and the cushion is configured so that positioning of the insert in the receptacle at different orientations varies the support/cushioning characteristics of the sole.

In one embodiment, the adjustable cushion insert is generally disk-shaped. In this embodiment, the cushion insert may be coaxially installed within a complementary disk-shaped receptacle. The mating surfaces of the cushion insert and the receptacle may include a plurality of projections such as lobes, contours, ridges and undulations that are interfitted when the cushion insert is installed in the receptacle. The lobes may be a series of waves undulating through regular angular sections. One or more of the lobes may be truncated or otherwise varied to provide differentiation in the support/cushioning characteristics of the sole. In one embodiment, the lobes are truncated along an angled plane.

The cushion insert may be selectively installed in the receptacle at different angular orientations to provide different cushioning or support characteristics. In the disk embodiment, the characteristics of the lobes may vary around the extent of the cushion insert such that changing the angular orientation varies the support/cushioning characteristics of the sole construction.

In one embodiment, the cushion insert may define a central through-hole or bore configured to fit over a corresponding post in the midsole. The cushioning insert may be rotatably fitted over the post. As a result, the sole construction may be adjusted simply by rotating the cushion insert about the post.

In one embodiment, the cushion insert is adjustable at least between four positions, including "supination," "pronation," "firm" and "regular" settings. In a disk embodiment, the consumer has the ability to rotate the cushion insert to adjust the sole construction to provide regular or firm cushioning, or to address supination or pronation.

The present invention provides a simple and effective construction that allows a sole to be easily adapted to match the needs of different wearers. In those embodiments that include a disk-shaped cushion insert, the sole can be adjusted simply by rotating the cushion insert within the receptacle. For example, simple rotation of the cushioning insert can permit the sole to be adjusted between regular or firm support, or to address pronation or supination. Because the sole may be adjusted by varying the orientation of a single cushion insert, it is not necessary to supply a wearer with a collection of different inserts that may increase cost and could become lost or misplaced. Further, the wearer is not required to save and store unused adjustable inserts to allow for possible future adjustments. A pair of shoes incorporating cushioning inserts with 8 different orientations in each shoe provides the wearer with 64 different adjustment combinations.

These and other objects, advantages, and features of the invention will be readily understood and appreciated by reference to the detailed description of the current embodiment and the drawings.

BRIEF DESCRIPTION OF THE DRAWINGS

FIG. 4*c* is a partially sectional view of the rear of the sole construction.

FIG. 9*b* is a bottom plan view of the cushion insert.

FIG. 11*a* is a front view showing left and right cushion inserts adjacent to one another.

FIG. 11*b* is a front view of an alternative left cushion insert of greater thickness than the left cushion insert of FIG. 11*a*.

FIG. 29*a* shows the insert in the pronation position and FIG. 29*b* shows the insert in the firm position.

FIG. 30*a* shows the insert in the supination position and FIG. 30*b* shows the insert in the regular position.

DESCRIPTION OF THE CURRENT EMBODIMENT

Figure 1:
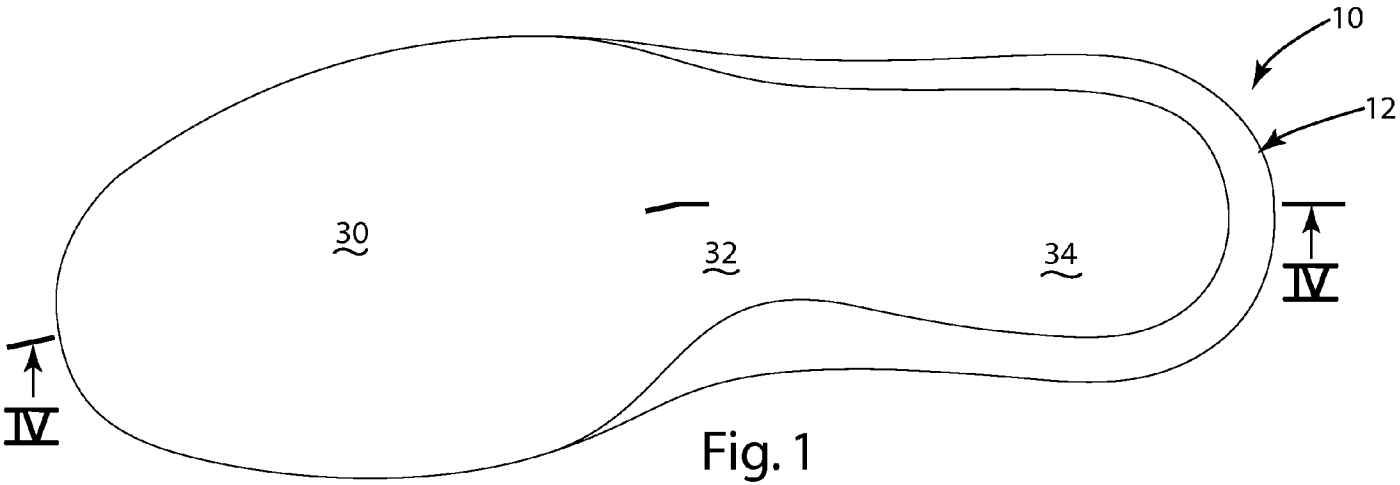
FIG. 1 is a top plan view of a sole construction in accordance with an embodiment of the present invention.

A sole construction in accordance with an embodiment of the present invention is shown in FIGS. 1-11 and generally designated 10. The illustrated embodiment generally includes a midsole 12, a cushion insert 14 and a heel wedge 16. The midsole 12 defines a receptacle 18 adapted to receive the cushion insert 14. The heel wedge 16 is positioned below the midsole 12/cushion insert 14 combination. The top surface 20 of the cushion insert 14 includes a plurality of lobes 24 and the bottom surface 22 of the receptacle 18 includes a plurality of lobes 26. The lobes 24 and 26 may be of different shapes so that they provide different support/cushioning characteristics. The lobes 24 and 26 are interfitted when the cushion insert 14 is installed in the receptacle 18. The components may be seated within essentially any article of footwear. For purposes of disclosure, the present invention is described in connection with a midsole construction. The present invention may, however, be integrated into other sole components, such as an outsole, an insole or a heel wedge. In a midsole construction, the sole construction 10 is typically disposed above or seated within a void in the outsole (not shown). Further the present invention is described in connection with a cushion insert positioned in the heel region. A cushion insert may alternatively or additionally be positioned in other regions of the sole, such as under the forefoot or other locations where the type of adjustability provided by this construction may be desirable.

The present invention is described in connection with a set of illustrations that include dimensions, notes and other annotations. The dimensions, notes and other annotations contained on the illustrations are exemplary and should not be interpreted to limit the scope of the present invention.

Figure 28:
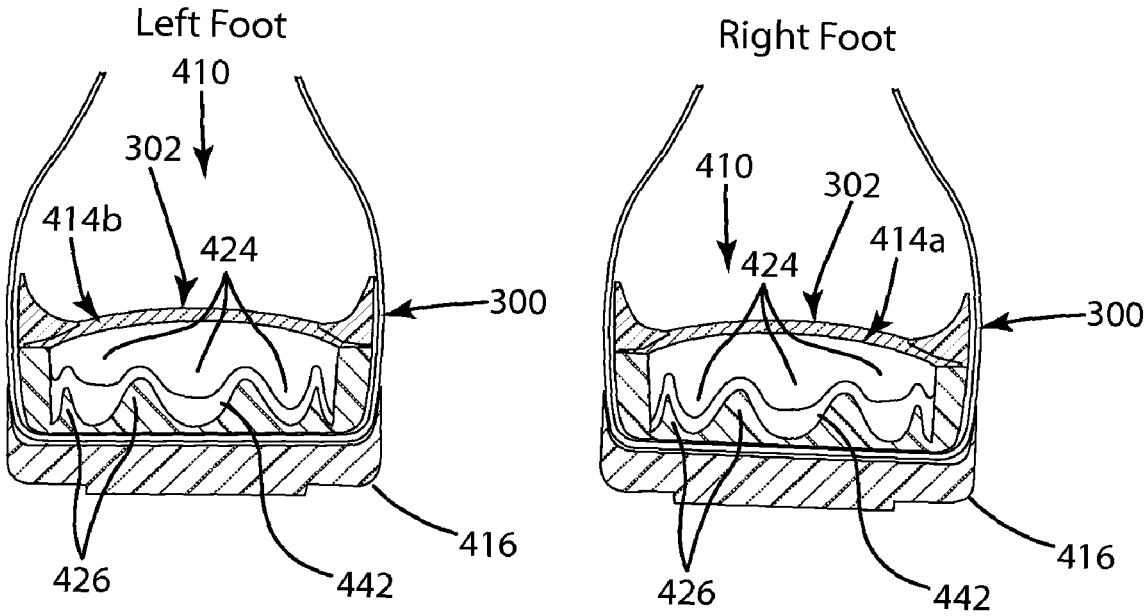
FIG. 28 is a sectional view showing left and right sole constructions adjacent to one another.
Figure 29A:
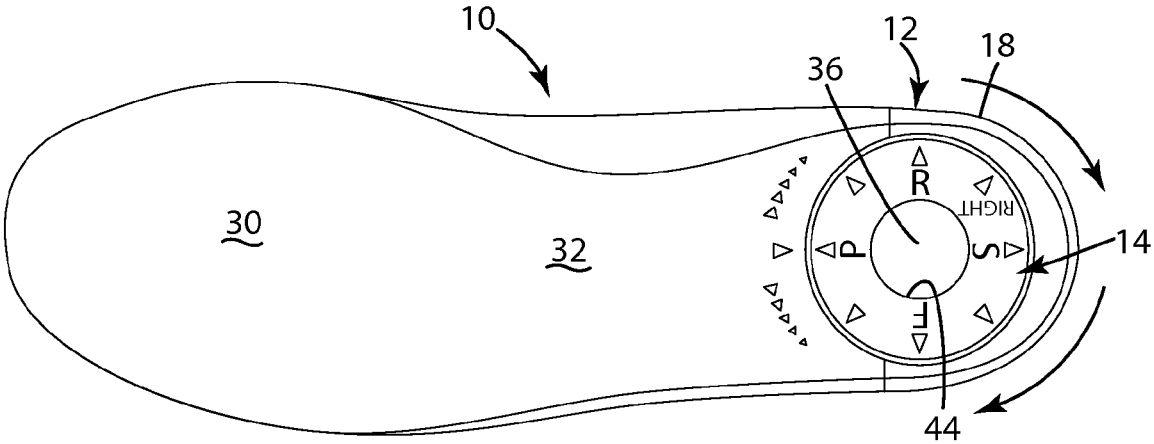
FIG. 29*a-b* are bottom plan views of the sole construction.
Figure 29B:
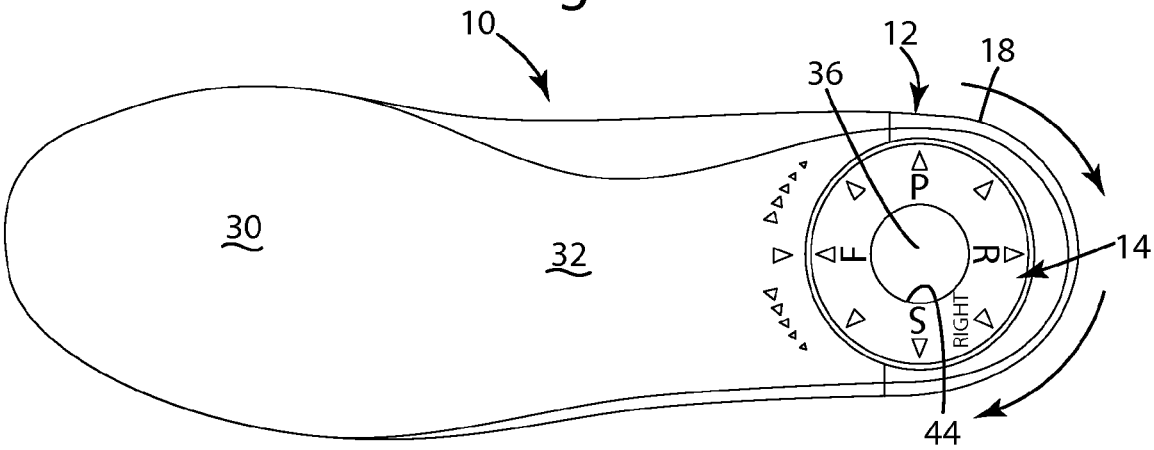
Figure 30A:
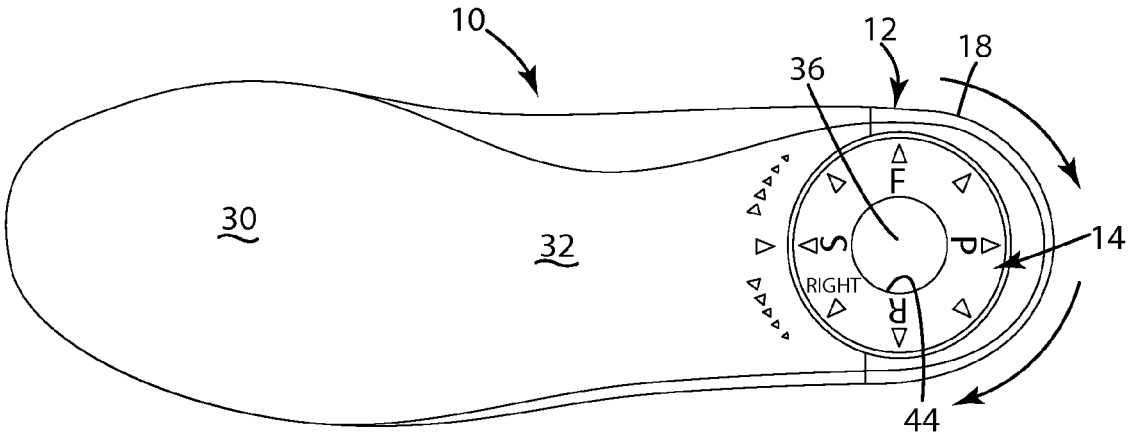
FIG. 30*a-b* are bottom plan views of the sole construction.
Figure 30B:
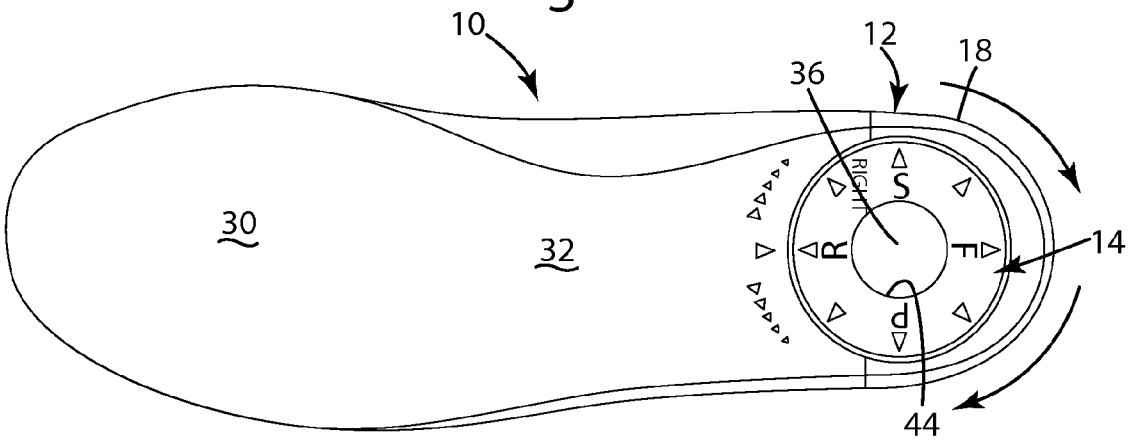

The present invention is primarily described in connection with a sole construction 10 configured to be incorporated into a right shoe. The sole construction for the left shoe may be a mirror image of the described right sole construction 10. Accordingly, the left cushion insert may be a mirror image of the right cushion insert 14. For example, FIG. 28 shows left and right assemblies of an alternative embodiment of the present invention.

In the embodiment of FIGS. 1-11, the midsole 12 provides the main cushioning body of the sole. The midsole 12 of this embodiment is a full-length midsole that follows the general shape of an article of footwear and is configured to be fitted into an upper above an outsole or other underlying sole component (See FIGS. 1 and 2). The midsole 12 of this embodiment is a single unitary construction that is essentially coextensive with the outsole, however, the midsole may be a collection of separate components or may be a partial midsole configured to extend through only one or more select portions of the sole. Referring again to the illustrated embodiment, the midsole 12 includes a forefoot region 30, an arch region 32 and a heel region 34. The forefoot region 30 is configured to support the wearer's forefoot. The arch region 32 may be shaped to provide an arch support. Although not shown, a shank or substantially rigid arch support may be added to the midsole in the arch region 32 if contours in the arch region of the midsole 12 are not sufficient to provide the desired level of arch support. If desired, a separate shank may be incorporated into the sole construction between the midsole 12 and the outsole or other locations. The heel region 34 defines a receptacle 18, which is configured to receive the cushion insert 14. Although this embodiment shows a single receptacle 18 in the heel region, the receptacle 18 may be located in other positions, such as in the forefoot region, and the midsole 12 may define a plurality of receptacles configured to receive a plurality of cushion inserts. For example, separate cushion inserts may be located in the heel region and in the forefoot region to provide adjustability in both areas of the sole. In the illustrated embodiment, the receptacle 18 is a generally disc-shaped void having a central post 36 (See FIGS. 2 and 4*a*-4*b*). The central post 36 is configured to receive the cushion insert 14 as described in more detail below. The size, shape and configuration of the central post 36 may vary from application to application to vary the characteristics of the sole construction 10. For example, the diameter of the post 36 may be increased or decreased to control the amount of support provide at the center of the heel region. The central post 36 is optional and the cushioning insert 14 may simply be fitted into a disc-shaped void when a central post 36 is not provided.

The receptacle 18 includes an interface surface 40 that is configured to engage the cushion insert 14 (See FIGS. 3*a*-*b* and 4*a*-*b*). The interface surface 40 may include a plurality of lobes 26 extending toward the cushion insert 14. The lobes 26 may be positioned around the interface surface 40 in a pattern of regular waves coinciding with angular sections of the receptacle 18. In the illustrated embodiment, the receptacle 18 includes eight lobes 26 arranged in a regular repeating pattern about the center of the interface surface 40. Although the lobes 26 of the illustrated embodiment are formed by smooth and continuous curved contours, the term "lobes" is used broadly to refer to essentially any contours, whether or not such contours are curved, smooth or run continuously together. The interface surface 40 of the receptacle may include a support layer 42, such as a thin layer of TPU or a harder EVA. The hardness of the support layer 42 may vary from application to application as desired. However, in the illustrated embodiment, the support layer 42 may have a durometer ranging between approximately 80-90 on the Asker A scale. The support layer 42 may be secured to the midsole 12. For example, the support layer 42 may be molded in situ to the midsole 12. As another example, the support layer 42 may be cemented or otherwise adhesively secured to the interface surface 40. The size, shape and configuration of the optional support layer 42 may be varied from application to application to provide the desired level of cushion/support while maintaining structural integrity. Further, the characteristics of the support layer 42 may be varied from region to region to provide regional variation in the characteristics of the sole.

The midsole 12 may be manufactured from essentially any material or combination of materials capable of providing the desired cushioning/support characteristics. In one embodiment, the midsole 12 is manufactured from polyurethane or EVA having the desired hardness/resiliency. The hardness of the midsole 12 may vary from application to application as desired. However, in the illustrated embodiment, the midsole 12 is manufactured from a single material having a durometer ranging between approximately 65-70 on the Asker C scale. The midsole 12 may be manufactured using essentially conventional molding techniques and apparatus. The midsole 12 may be injection molded as a single integral unit in which the receptacle 18 is formed during the molding process. The midsole 12 may alternatively be pre-manufactured (e.g. pre-molded) and then die cut or otherwise processed to form the receptacle 18. The midsole 12 may alternatively be manufactured from a plurality of multiple components, for example, with separate heel and forefoot portions. The separate components may be combined during manufacture, such as by compression molding or through the use of adhesives.

Figure 9A:
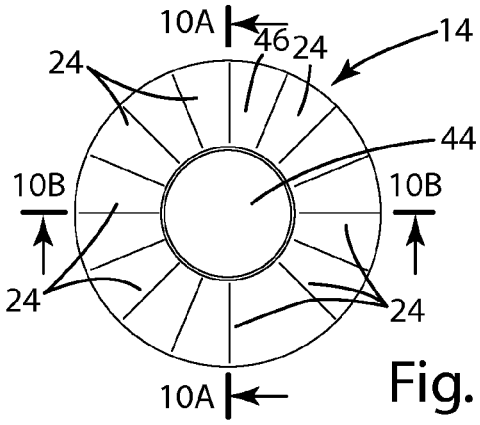
FIG. 9*a* is a top plan view of the cushion insert.
Figure 10A:
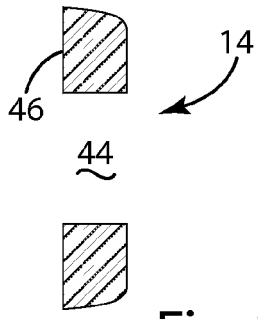
FIG. 10*a* is a sectional view of the cushion insert taken along line Xa-Xa of FIG. 9*a*.
Figure 10B:
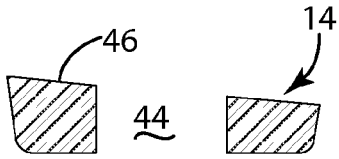
FIG. 10*b* is a sectional view of the cushion insert taken along line Xb-Xb of FIG. 9*b*.

The cushion insert 14 is configured to be removably fitted into the receptacle at a variety of different orientations (See FIGS. 5-8). In the illustrated embodiment, the cushion insert 14 is generally disc-shaped and is configured to be seated within the receptacle 18 (See FIGS. 2, 4*a* and 4*b*). Referring now to FIGS. 9*b* and 10*a*-*b*, the insert 14 defines a central hole 44 adapted to be fitted over central post 36. The central hole 44 and central post 36 may help to assist in aligning and/or retaining the insert 14 in the receptacle 18. The central post 36 and central hole 44 may, however, be eliminated or take on other configurations. For example, the central hole 44 and central post 36 may be configured to be snap-fitted together. Although not shown, the central post 36 may include a head (not shown) and the central hole 44 may define an enlarge space (not shown) to receive the head of the central post 36 when the cushion insert 14 is installed in the receptacle 18. As another example, the central post 36 and the central hole 44 may be shaped so that the insert 14 fits into the receptacle 18 only in select orientations. In this alternative embodiment, one of the two components may include a key and the other may include a plurality of slots that receive the key only when the insert 14 is in one of the permissible orientations.

The interface surface 46 of the cushion insert 14 includes a plurality of lobes 24 configured to be interfitted with the lobes 26 of the receptacle 18. One or more of the lobes 24 varies in size, shape or other characteristics from the remainder of the lobes 24 so that repositioning of the cushion insert 14 results in repositioning of the lobes 24 and therefore causes changes to the support/cushioning characteristics of the sole construction 10. In the illustrated embodiment, the lobes 24 and 26 are shaped to be closely interfitted with one another such that the only spaces occur in regions where the lobes 24 of the cushion insert 14 are intentionally truncated to provide adjustability. As perhaps best shown in FIG. 11*a*, the lobes 24 of the illustrated embodiment are truncated by a single common plane extending through the lobes 24 at an orientation selected to provide a uniform taper from full height lobes 24 on one side of the insert 14 to lobes of substantially less height at the opposite side. In different applications, the truncating plane may be disposed at alternative orientations as appropriate to provide the desired cushioning characteristics. Further, the lobes 24 need not be truncated by a single common plane, but may alternatively be truncated or otherwise varied as desired to provide the desired cushioning/support characteristics throughout the range of adjustment of the cushion insert.

Although the illustrated embodiment discloses truncated lobes, adjustability may be provided by varying essentially any characteristic of the cushion insert 14 or the lobes 24, such as size, shape, configuration and materials to provide the desired support/cushioning throughout the range of adjustability of the cushion insert 14. For example, the lobes may be manufactured from materials of different degrees of hardness. In an embodiment of this type, the cushion insert may be formed of lobes manufactured from different materials. Although the manufacturing process may vary, the different materials of the cushion insert may be cemented together, integrally molded using multiple shots or compression molded. As another example, a support layer (not shown) may be positioned over one or more of the lobes to provide the lobes with the desired characteristics. Although not shown, the support layer may be similar to support layer 42 of the receptacle 18. A firmer support layer may be provided over select lobes to provide enhanced firmness. A thinner support layer (or the absence of a support layer) over select lobes may provide reduced firmness in select regions. Variations in the thickness of the support layer may be used to provide the desired variations in lobe characteristics.

In addition to varying individual lobes 24 in the cushion insert 14 to provide adjustability, the contours and other characteristics of the midsole 12 and the cushion insert 14 may be varied from application to application. For example, variations in the thickness or materials of the midsole 12, the cushion insert 14 and/or the support layer 42, as well as changes in the size, shape, and configuration of the lobes 24 and 26 can be used to control the support/cushioning characteristics outside of the context of adjustability. In the illustrated embodiment, the lobes 24 and 26 transition from one lobe to the next smoothly following a continuous curve extending around the interface surfaces. When viewed from the end, the curve is generally sinusoidal. If desired, spacing may be provided between the lobes of one or both components. Also, one or more lobes 24 and 26 may be eliminated in the cushion insert to provide region(s) of reduced hardness. As another example, the lobes 24 and 26 may have different shapes, such as triangular, rectangular or square rather than curved profiles. Further, the shapes of interfitting lobes 24 and 26 need not be corresponding as shown in the illustrations. For example, a triangular lobe or a square lobe may be fitted into a curved void or other non-matching void shape.

Figure 2:
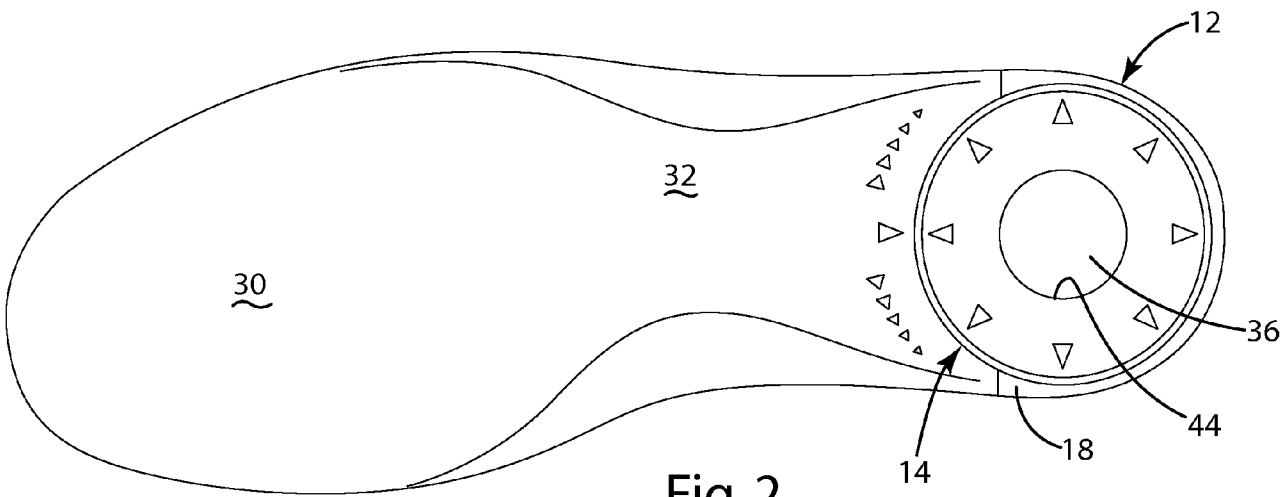
FIG. 2 is a bottom plan view of the sole construction.
Figure 4A:
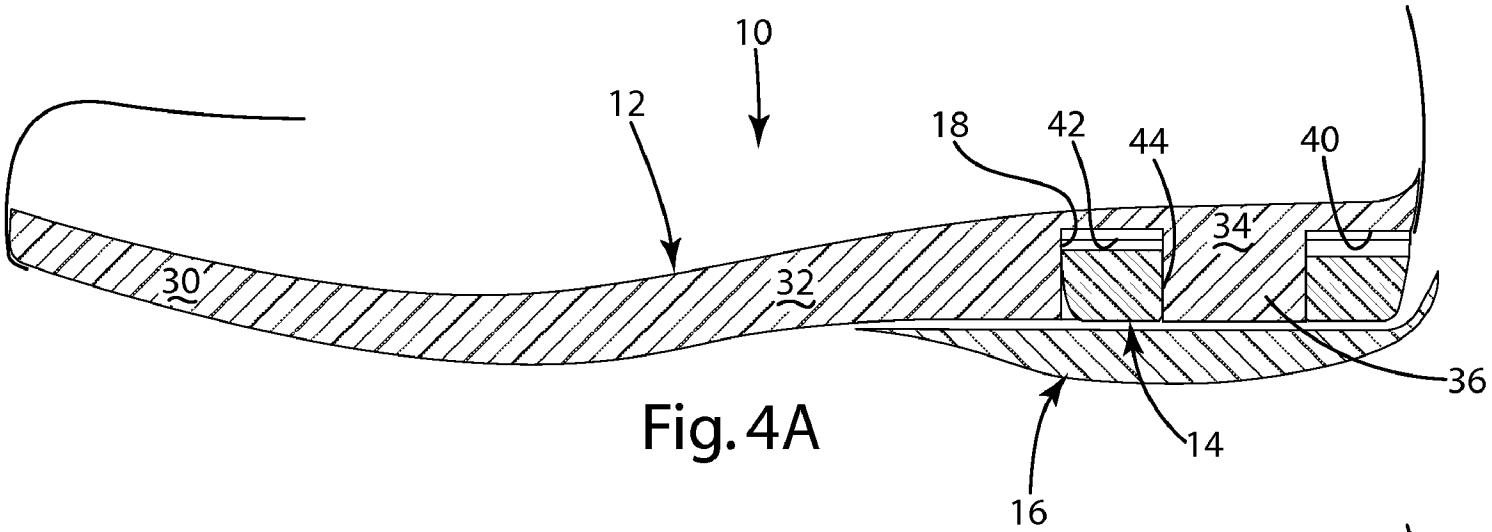
FIG. 4*a* is a sectional view of the sole construction taken along line IV-IV of FIG. 1 with the cushion insert in the supination position.
Figure 3A:
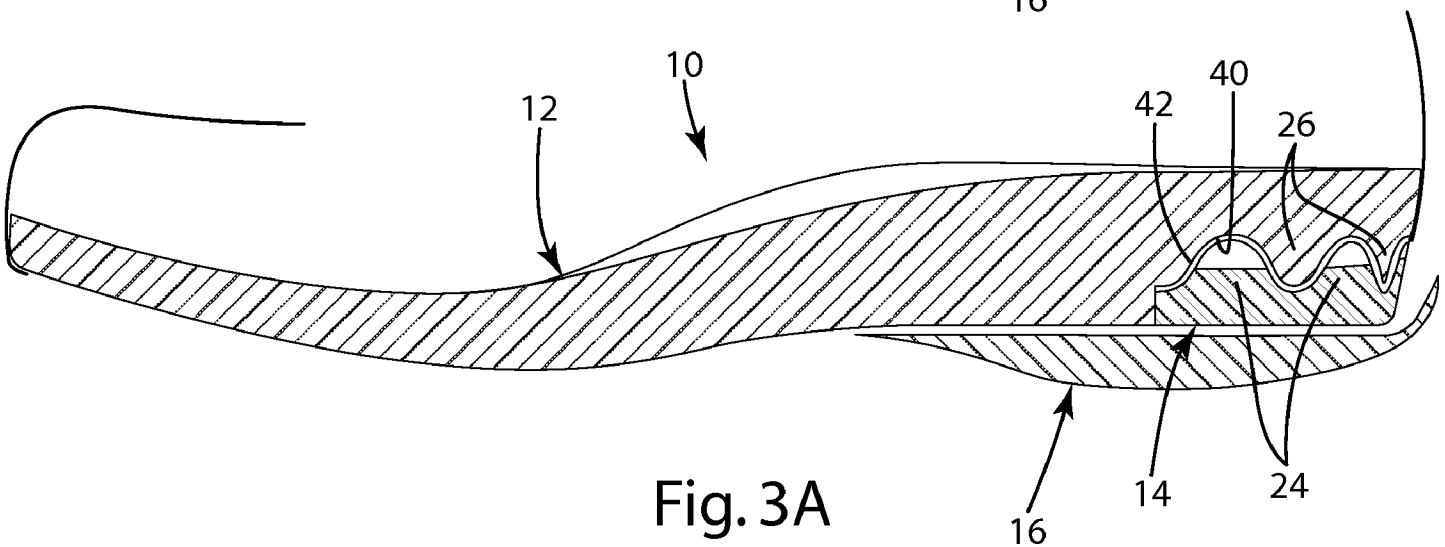
FIG. 3*a* is a side elevational view of the sole construction with the cushion insert in the supination position and the heel wedge shown in section.
Figure 3B:
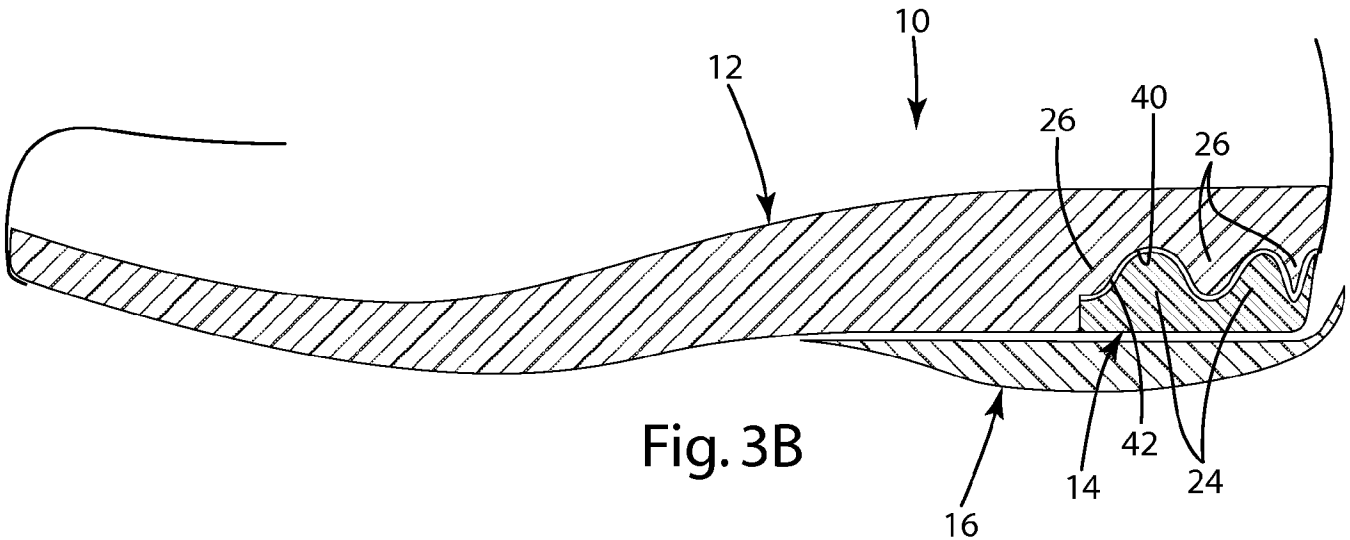
FIG. 3*b* is a side elevational view of the sole construction with the cushion insert in the pronation position and the heel wedge shown in section.
Figure 4B:
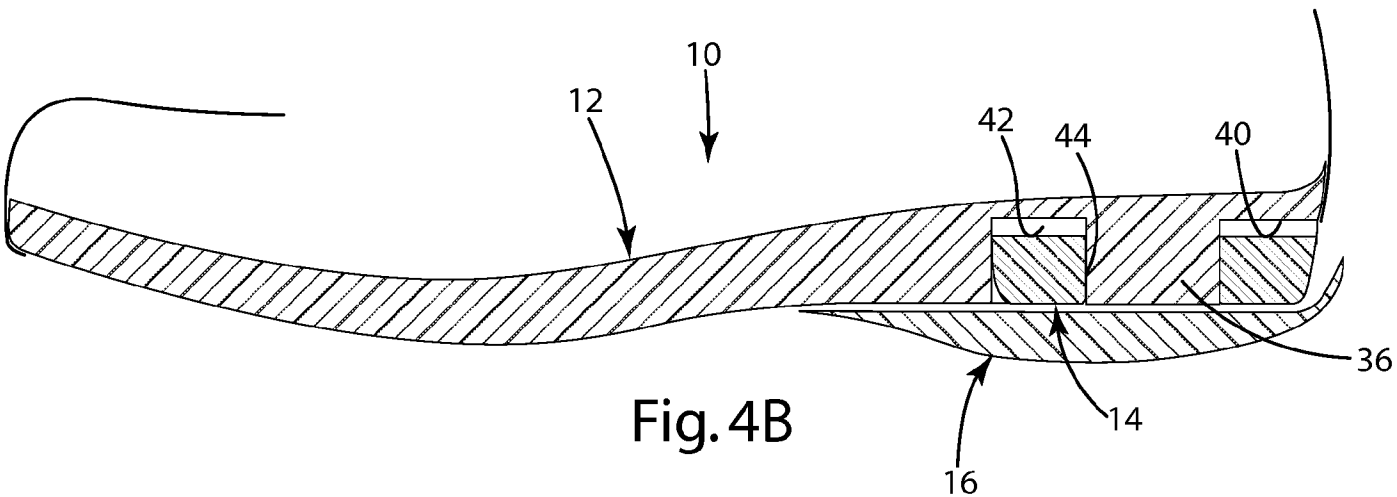
FIG. 4*b* is a sectional view of the sole construction taken along line IV-IV of FIG. 1 with the cushion insert in the pronation position and the support layer removed.
Figure 5:
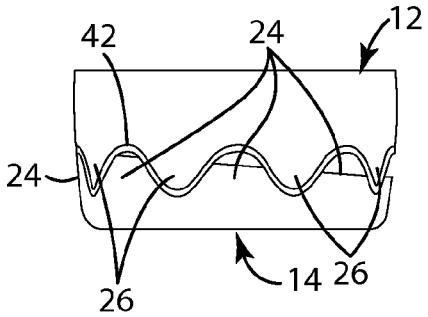
FIG. 5 is a rear view of the sole construction showing the cushion insert in the "pronation" position.
Figure 6:
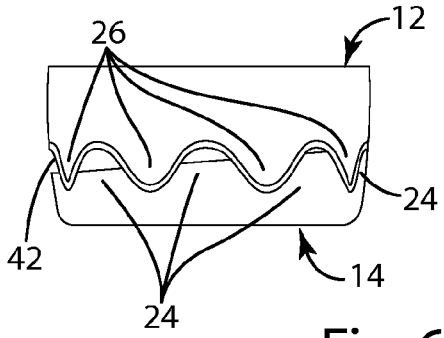
FIG. 6 is a rear view of the sole construction showing the cushion insert in the "supination" position.
Figure 8:
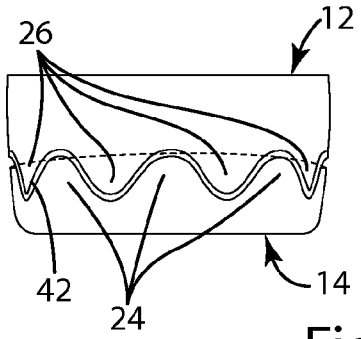
FIG. 8 is a rear view of the sole construction showing the cushion insert in the "regular" position.
Figure 7:
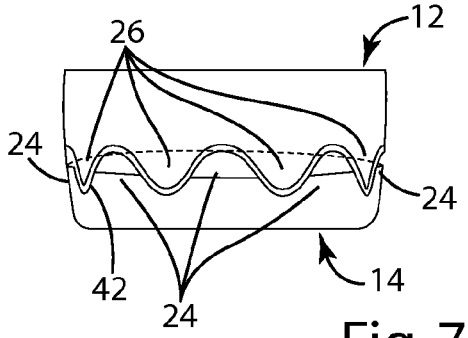
FIG. 7 is a rear view of the sole construction showing the cushion insert in the "firm" position.

The midsole 12 and cushion insert 14 may include graphics, printed material or other symbols that assist in adjusting the cushion insert 14. For example, as shown in FIG. 2, the midsole 12 may be provided with an alignment indicator 98 (in this case, an arrow) and the insert 14 may be provided with a plurality of similar alignment indicators 96 (in this case, a plurality of arrows) that show permissible orientations of the insert 14. The insert 14 may include text or symbols that work in conjunction with the alignment indicators 96 and 98 to provide a visual indication of the results of the cushion insert 14 orientation. For example, the words "PRONATION," "SUPINATION," "REGULAR," and "FIRM" may be printed on the insert adjacent to the appropriate alignment indicators 96 (See FIGS. 29*a*-30*b*.). FIGS. 5-8 show the cushion insert 14 in the "pronation," "supination," "firm" and "regular" positions, respectively.

In the illustrated embodiment, the sole construction 10 includes a heel wedge 16 that provides additional cushioning and elevation in the heel region of the sole (See FIGS. 3*b* and 4*a*-*c*). The heel wedge 16 may be shaped to provide a cup-shaped surface to receive and support the undersurface of the midsole 12 and the insert 14 in the heel region. The heel wedge 16 is an optional component and may be eliminated, for example, when sufficient heel cushioning and elevation are provided by other sole components, such as an underlying outsole. In the illustrated embodiment, the heel wedge 16 is manufactured separately from the outsole and other sole components. If desired, the heel wedge 16 may be integrated into the outsole or other sole component underlying the midsole 12 and insert 14.

The midsole 12, insert 14 and heel wedge 16 may be incorporated into essentially any footwear construction. The assembly of FIGS. 1-11 may be removably fitted into an article of footwear, for example, by dropping the assembly through the foot opening into an upper and positioning it above the outsole. The heel wedge 16 may be permanently secured to the article of footwear even if the midsole 12 and insert 14 are removable. Alternatively, the assembly (excluding the cushion insert 14) may be permanently integrated into the construction, for example, by cementing the midsole 12 and heel wedge 16 in place. Although it is not strictly necessary for the cushion insert 14 to be removable, the user should be capable of adjusting the cushion insert 14 from one orientation to the next. For example, the cushion insert 14 need not be removable if it can be rotated from one orientation to the next without being removed.

Figure 18A:
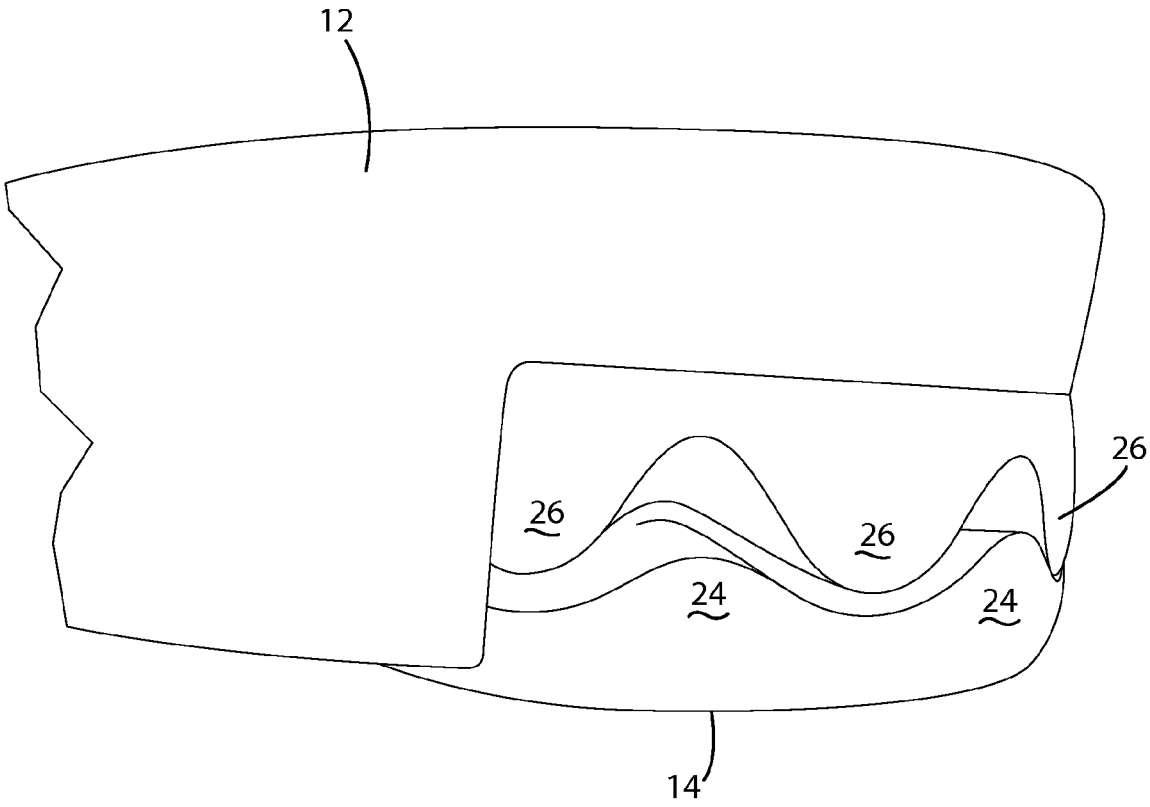
FIG. 18*a* a side elevational view of the sole construction with the cushion insert of FIGS. 1-11 in the supination position and the heel wedge shown in section.
Figure 18B:
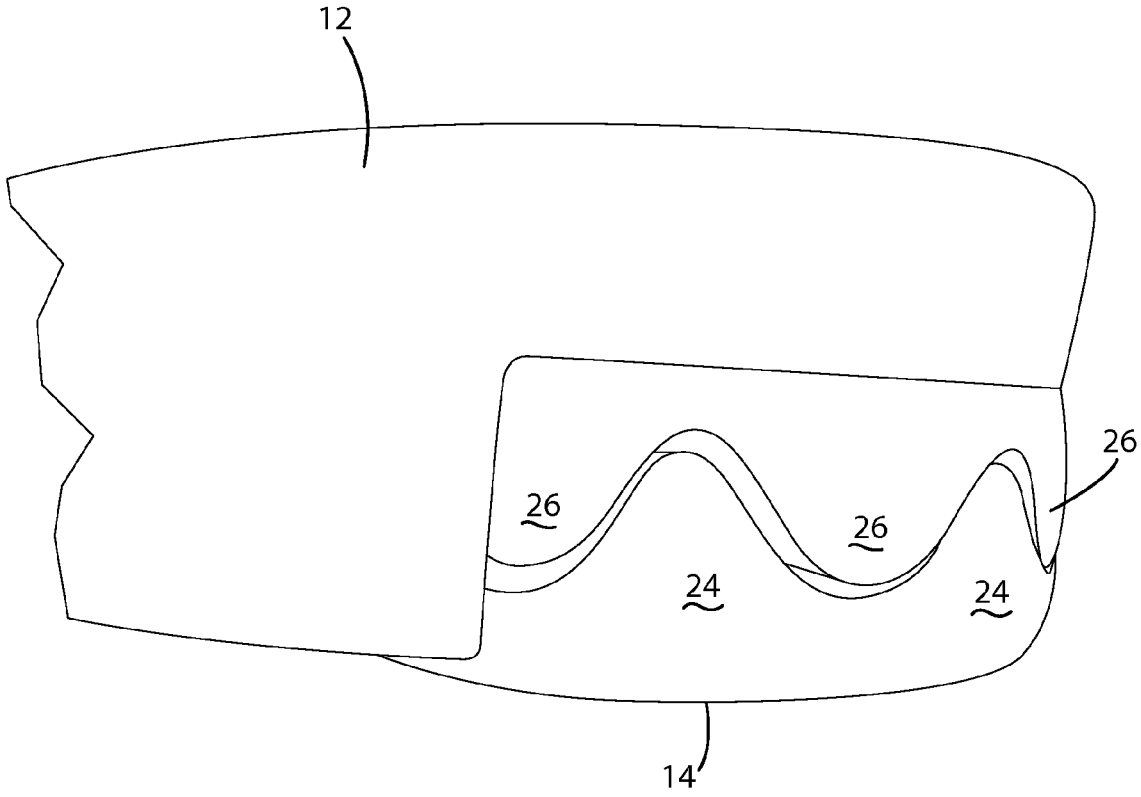
FIG. 18*b* is a side elevational view of the sole construction with the cushion insert of FIGS. 1-11 in the pronation position and the heel wedge shown in section.
Figure 18C:
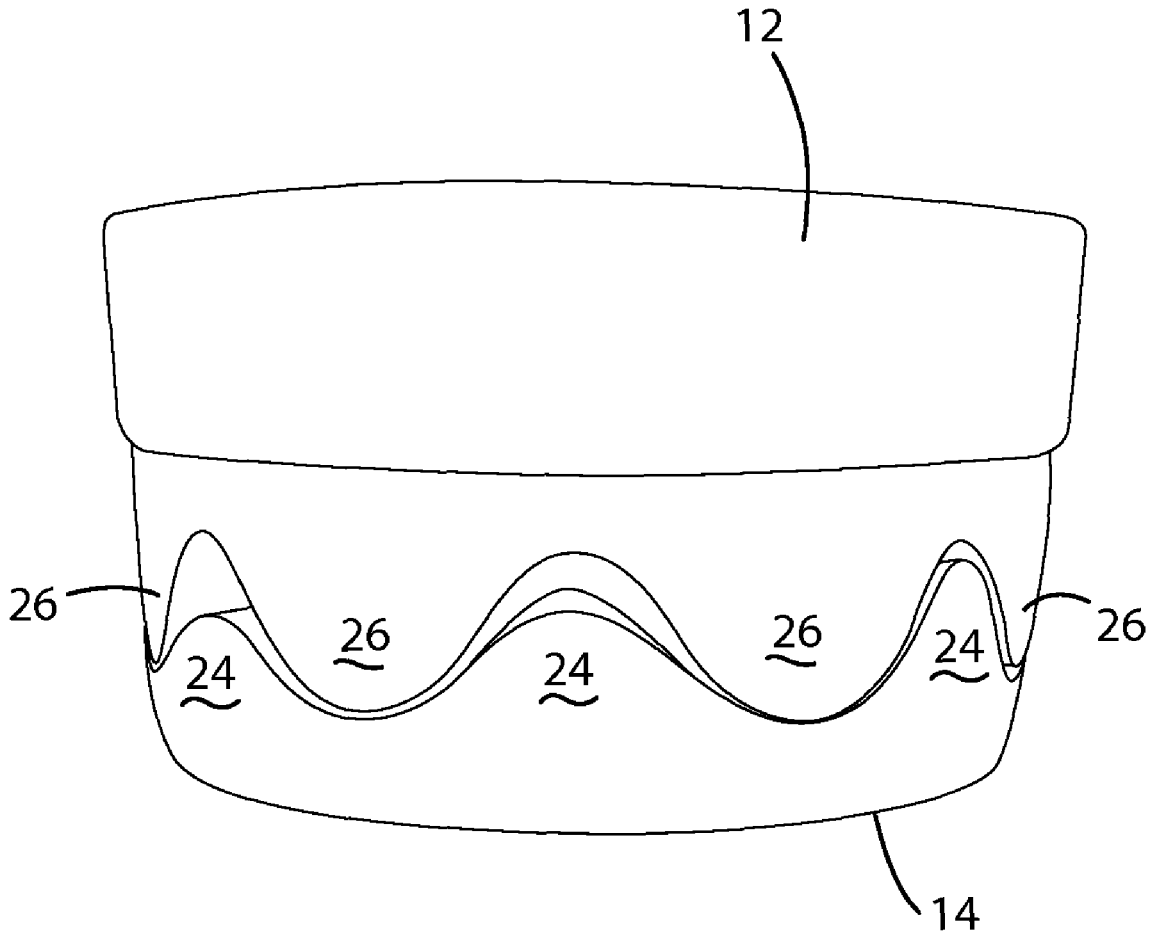
FIG. 18*c* is a rear view of the sole construction showing the cushion insert of FIGS. 1-11 in the "pronation" position.
Figure 18D:
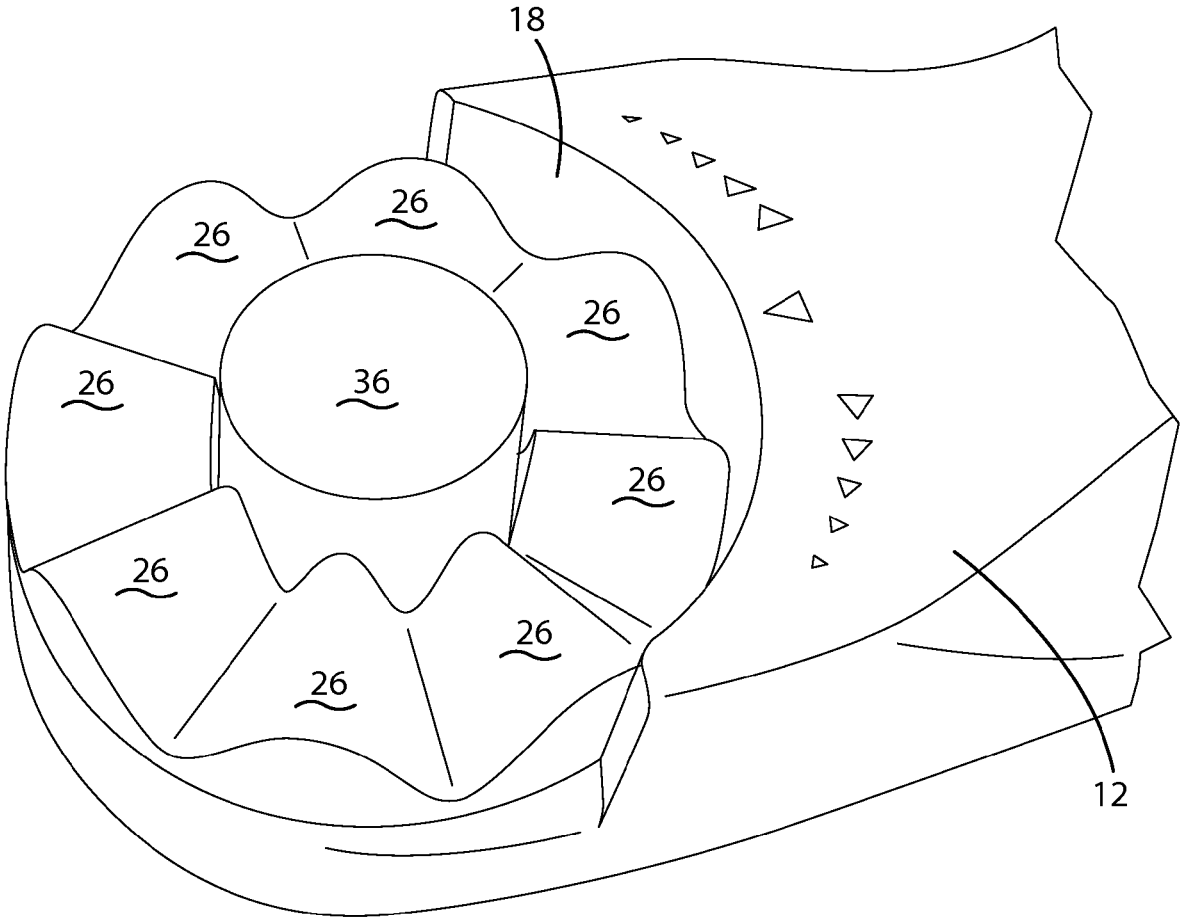
FIG. 18*d* is a top plan view of the sole construction showing the receptacle into which the cushion insert of FIGS. 1-11 is placed.
Figure 18E:
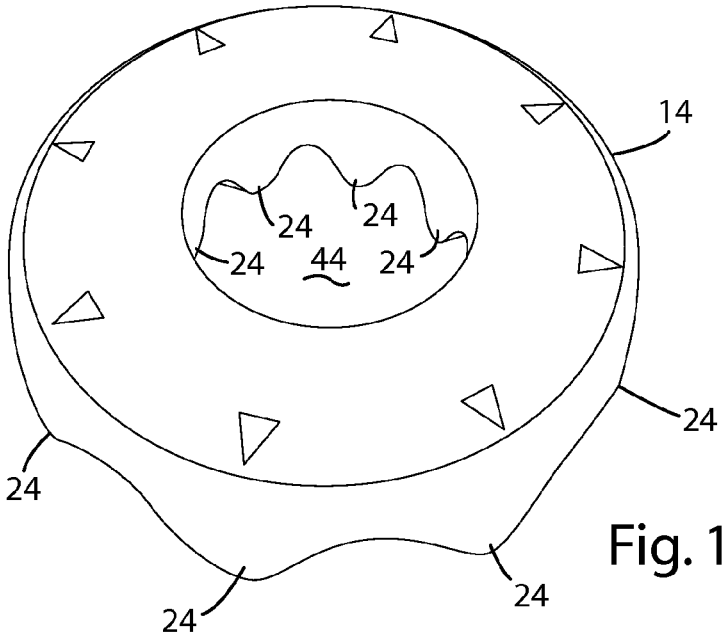
FIG. 18*e* is a bottom plan view of the cushion insert of FIGS. 1-11.

A plurality of drawings of a midsole and cushioning insert of an embodiment similar to that illustrated in FIGS. 1-11 are shown in FIGS. 18*a*-*e*. Although similar to the embodiment of FIGS. 1-11, the embodiment does not include, among other things, support layer 42. Further, the lobes of the cushion insert vary in height rather than being truncated by a plane as in the embodiment of FIGS. 1-11. The drawings are labeled with reference numbers corresponding to the reference numbers used in connection with FIGS. 1-11. FIGS. 18*a*-*e* depict the cushion insert 14 that is installed in the midsole 12. As can be seen, the cushion insert 14 is fitted over post 36. FIG. 18*a* shows the right side of the heel region of the prototype with the cushion insert in a first position. FIG. 18*b* shows the right side of the heel region of the prototype with the cushion insert in a second position. FIG. 18*c* shows the heel region of the prototype from the rear with the cushion insert 14 is a first position. FIG. 18*i* shows the heel portion of the midsole 12 with the cushion insert 14 removed. FIG. 18*k* shows the bottom of the cushion insert.

Figure 14:
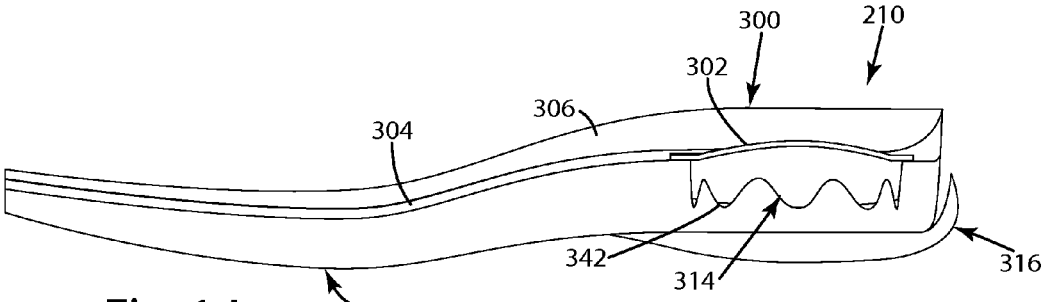
FIG. 14 is a sectional view of the alternative sole construction taken along line XIV-XIV of FIG. 12.
Figure 16:
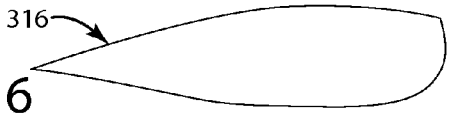
FIG. 16 is a side elevational view of the heel wedge.
Figure 15:
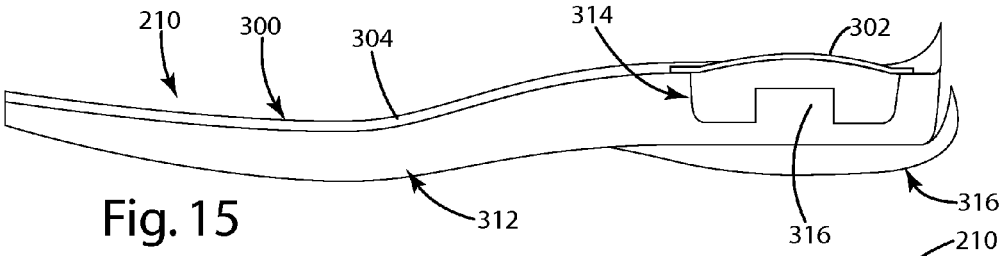
FIG. 15 is a partially section view of the alternative sole construction taken along line XV-XV of FIG. 12.
Figure 12:
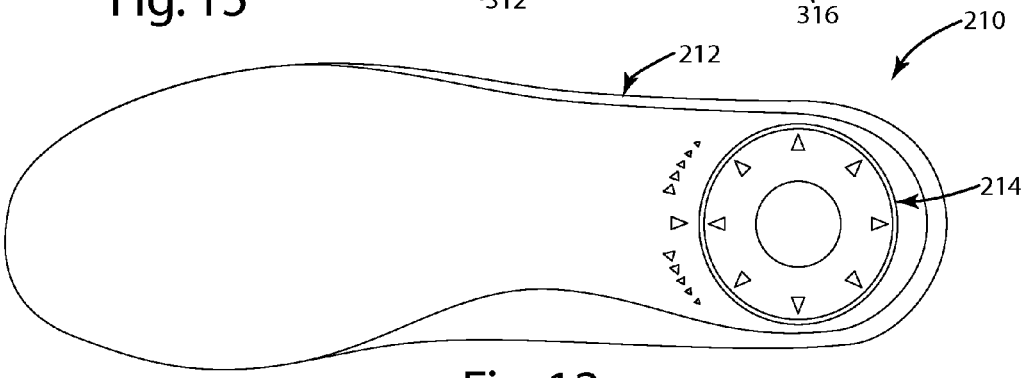
FIG. 12 is a top plan view of a sole construction in accordance with an alternative embodiment of the present invention.

An alternative embodiment is shown in FIGS. 12-17. In this alternative embodiment, the sole construction 210 is configured so that the cushion insert 214 is accessible from the top surface of the midsole 212 (See FIG. 12). As shown in FIG. 15, the sole construction 210 of this embodiment generally includes a midsole 212, a cushion insert 214 and a heel wedge 216. The midsole 212 is largely identical to midsole 12 described above. However, the receptacle 218 opens upwardly so that the cushion insert 214 is inserted into the midsole 212 from the top, thereby facilitating adjustment of the cushion insert 214 without removal of the midsole 212 from the shoe. Further, the central post 236 of this embodiment is configured so that it does not extend entirely through the cushion insert 214. Rather, the cushion insert 214 defines a central bore 244 that extends into the cushion insert 214 from the interface surface 246. The central post 236 may include a head (not shown) and the central bore 244 may define a corresponding enlarged void (not shown) that permitted the cushion insert 214 to be snap-fitted onto the central post 236. The heel wedge 216 is essentially identical to heel wedge 16 described above. The heel wedge 216 may be incorporated directly into the midsole 212, if desired.

Figure 13:
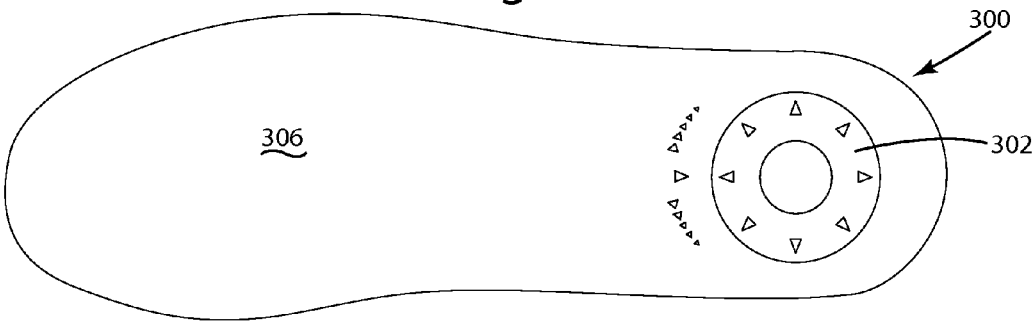
FIG. 13 is a top plan view of a sock liner of the alternative sole construction.
Figure 17:
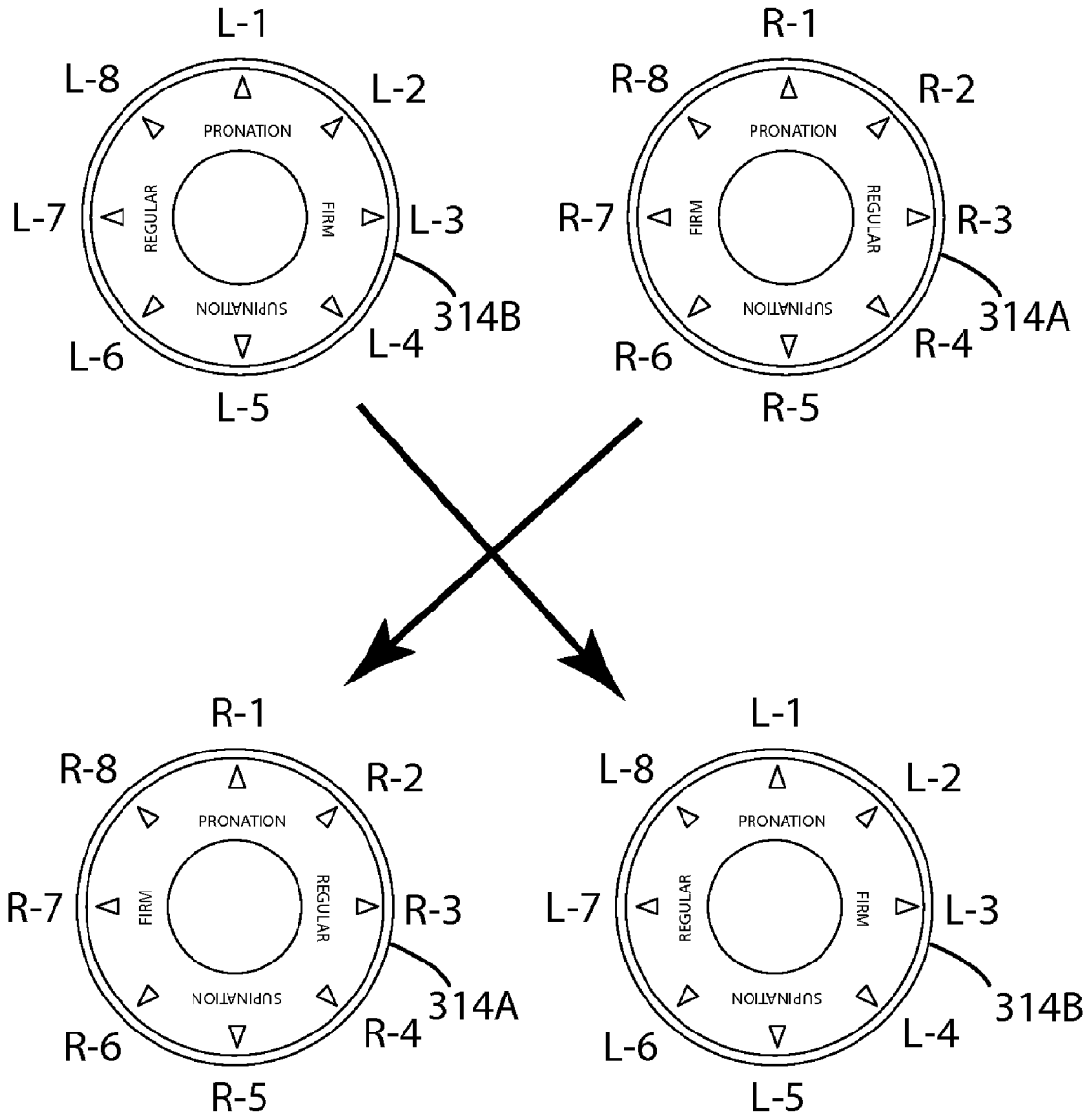
FIG. 17 is a schematic drawing representing one adjustment combinations available in a pair of shoes incorporating an embodiment of the present invention.

This alternative embodiment may also include an optional sock liner 300 (See FIGS. 13 and 14). The design and configuration of the sock liner 300 may vary from application to application. For example, the sock liner may be a conventional laminated construction (e.g. assembled from a plurality of different layers) or it may be a conventional unitary construction. In the illustrated embodiment, the sock liner 300 is a laminated construction and generally includes a cushion layer 304 and a cover layer 306. The cushion layer 304 of this embodiment may be manufactured from essentially any cushioning material, such as EVA, polyurethane or gel. The cover layer 306 of this embodiment may be manufactured from a soft, yet durable cloth or fabric material, such as cotton, wool and polypropylene blends. If desired, the sock liner 300 may be treated with antimicrobial, anti-odor and/or other functional treatments. As shown, the sock liner 300 may include a window 302 that permits viewing of the cushion insert 214 when the sock liner 300 is installed in the shoe. The window 302 may simply be an opening in the sock liner 300 or it may be filled with a transparent or translucent material. Although shown only in connection with the embodiments of FIGS. 12-17 and 20-28, essentially any construction may include an optional sock liner. In applications where the cushion insert is fitted into the undersurface of the midsole, there may be no need for a window in the sock liner.

The present invention may be incorporated into essentially any type of footwear, including but not limited to shoes, boots, sandals, slippers and athletic wear. Further, the present invention may be incorporated into essentially any footwear construction. For example, the sole construction may be incorporated into direct attach, welt, cement, stroble, California, opanka, lasted, slip lasted and other footwear constructions. The entire sole construction may be removably fitted into a void in an outsole, midsole or other sole component. Alternatively, select components of the present invention, such as the midsole and heel wedge, may be secured to the remainder of the sole. In this alternative, the cushion insert may be removable (or at least adjustable within the receptacle). If an optional sock liner is included in the construction, it will typically be removable if its removal is necessary to provide access to the cushion insert.

Figure 19A:
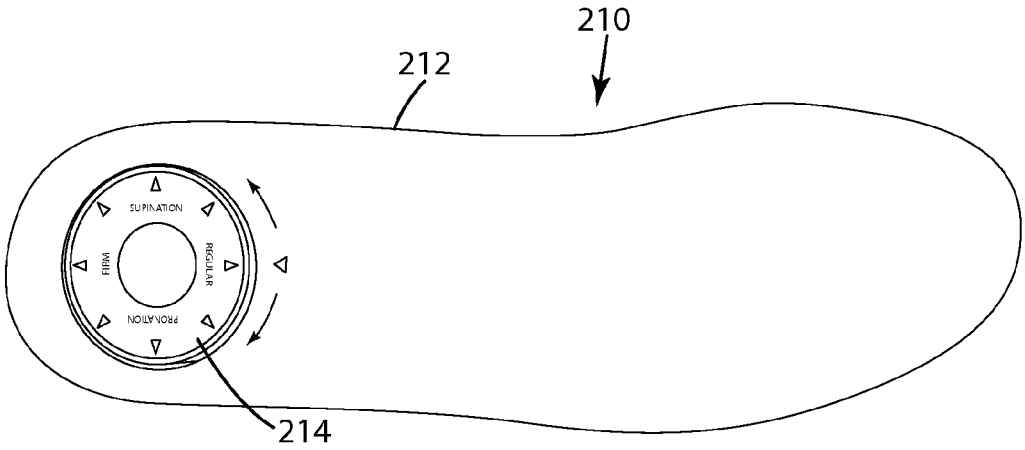
FIG. 19*a* is a top plan view of a sole construction in accordance with an embodiment shown in FIGS. 12-17.
Figure 19B:
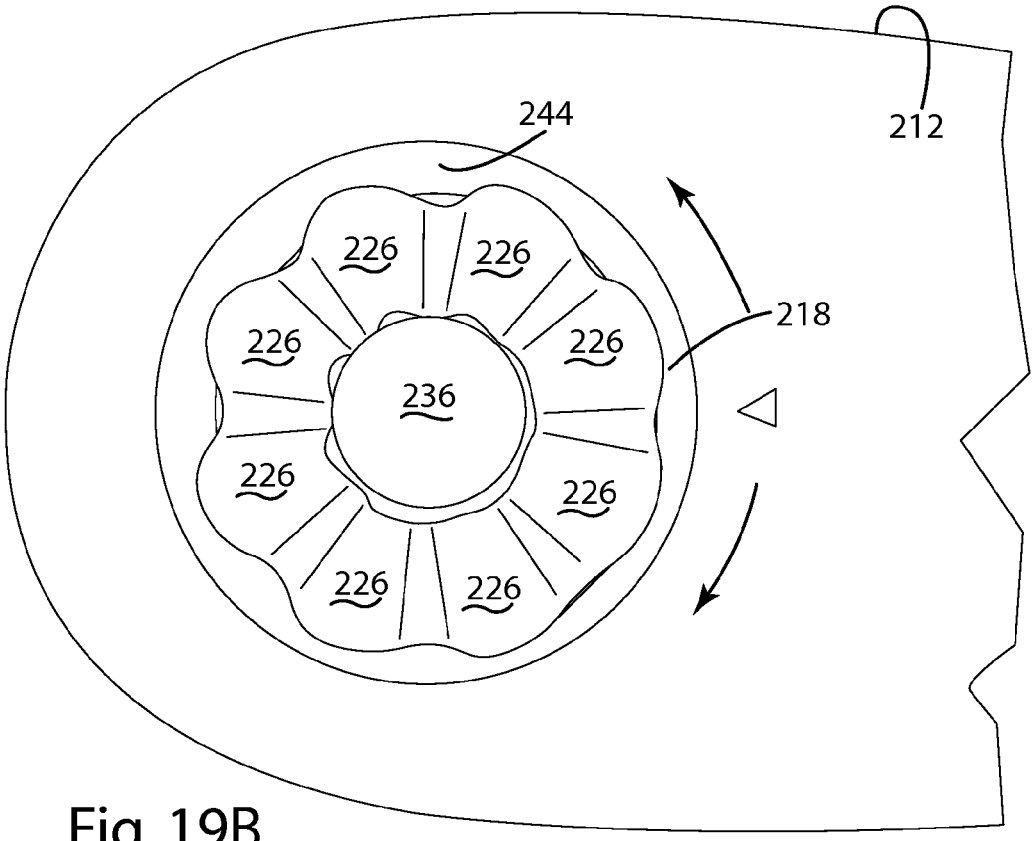
FIG. 19*b* is a top plan view of the receptacle into which the cushion insert is placed.
Figure 19C:
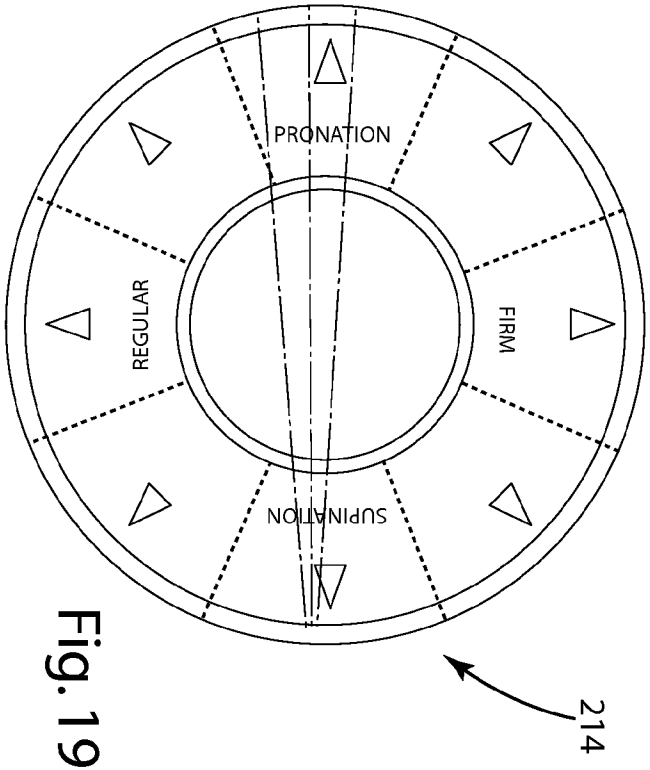
FIG. 19*c* is a top plan view of the cushion insert shown in FIGS. 12-17.
Figure 19D:
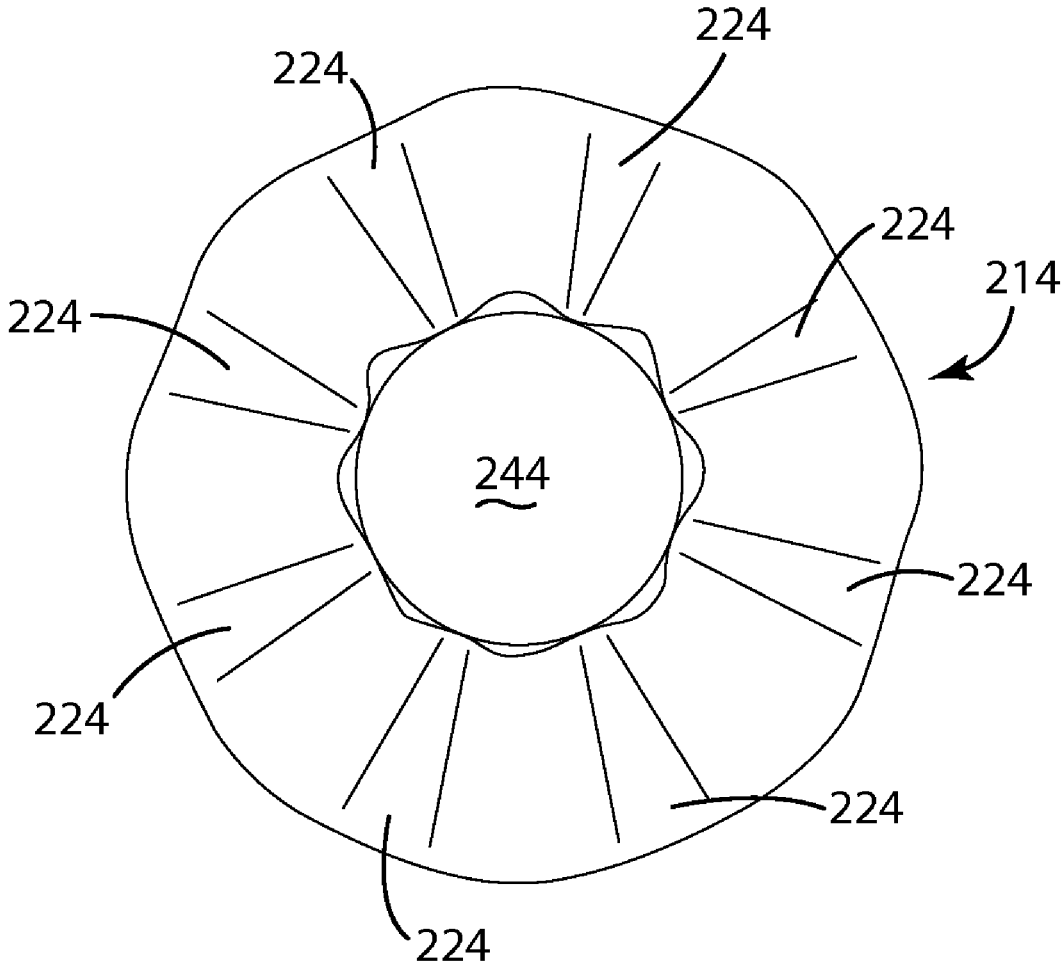
FIG. 19*d* is a bottom plan view of the cushion insert shown in FIG. 12-17.
Figure 20:
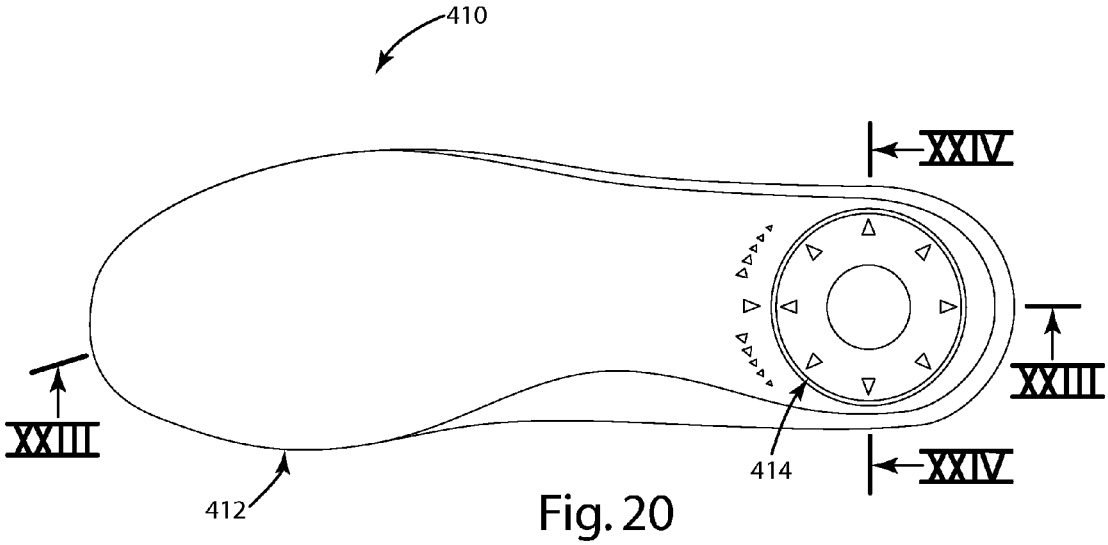
FIG. 20 is a top plan view of a sole construction of a second alternative embodiment.

A plurality of drawings of a midsole and cushioning insert of an embodiment similar to that illustrated in FIGS. 12-17 are shown in FIGS. 19*a-d*. Although similar to the embodiment of FIGS. 12-17, the embodiment does not include, among other things, support layer 242. Further, the lobes of the cushion insert vary in height/shape rather than being truncated by a plane as in the embodiment of FIGS. 12-17. The drawings are labeled with reference numbers corresponding to the reference numbers used in connection with FIGS. 12-17. FIG. 19*a* shows the top of the prototype showing the cushion insert 214 installed in the midsole 212. FIG. 19*b* shows the heel region of the midsole 212 with the cushion insert 214 removed. FIG. 19*c* shows the top of the cushion insert. FIG. 19*d* shows the bottom of the cushion insert.

Figure 21:
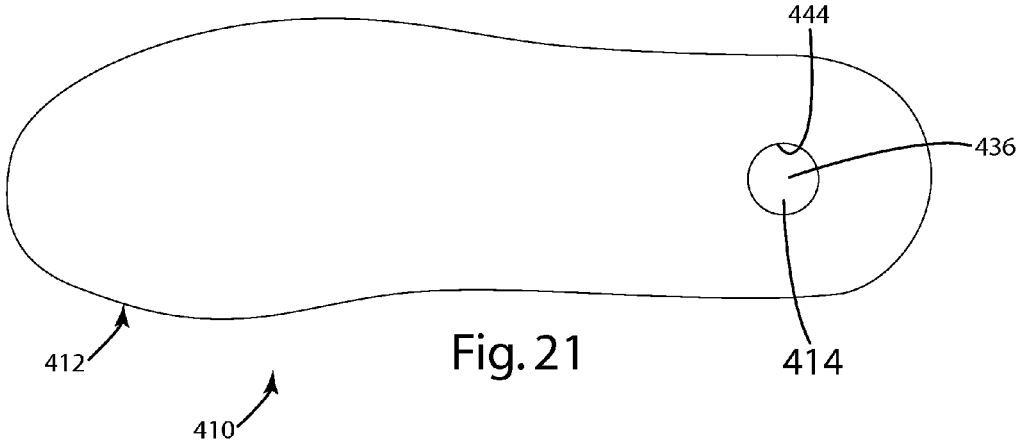
FIG. 21 is a bottom plan view of the sole construction of the second alternative embodiment.
Figure 23:
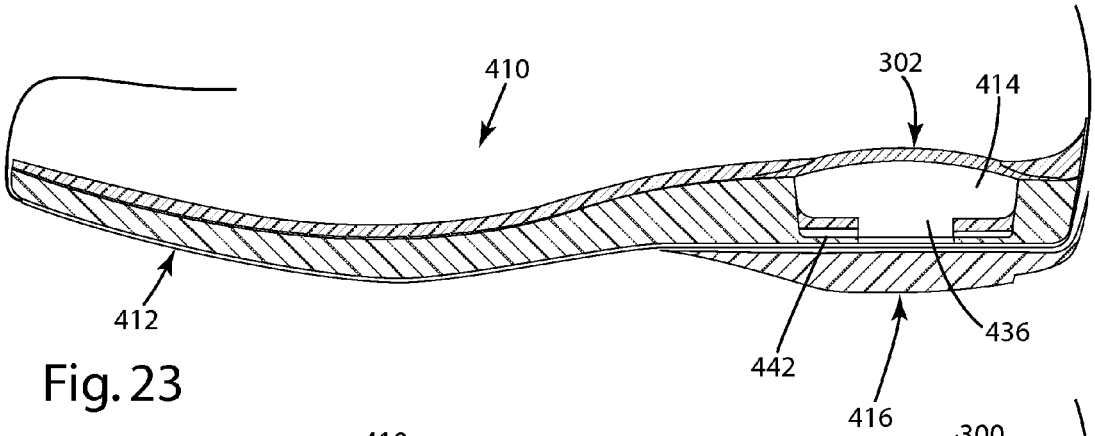
FIG. 23 is a sectional right side elevational view of the sole construction of the second alternative embodiment taken along line XXIII-XXIII of FIG. 20.
Figure 22:
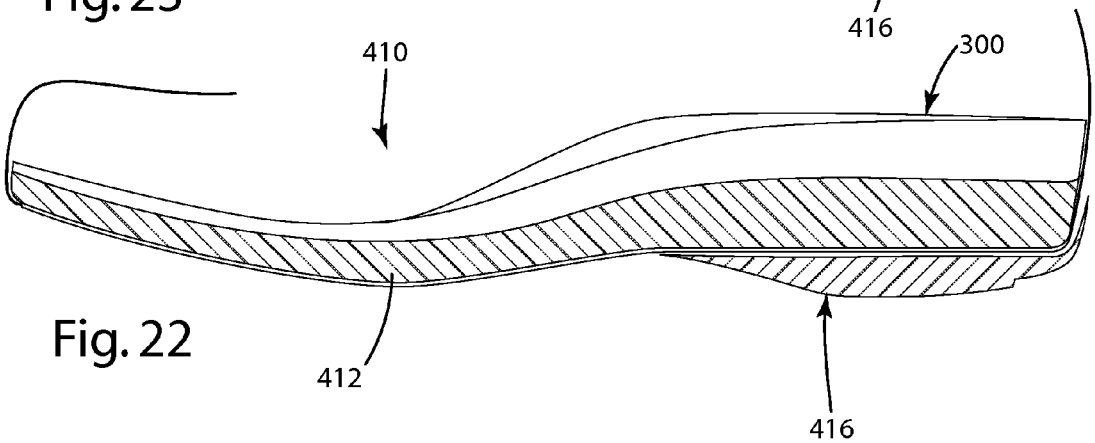
FIG. 22 is a right side elevational view of the sole construction of the second alternative embodiment.
Figure 24:
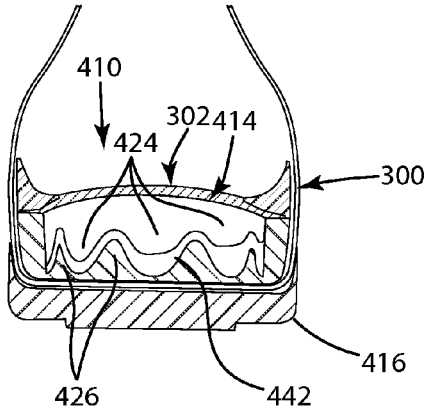
FIG. 24 is a sectional rear view of the sole construction of the second alternative embodiment taken along line XXIV-XXIV of FIG. 20.
Figure 25A:
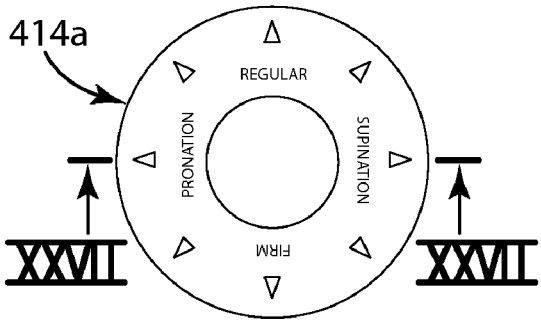
FIG. 25*a* is a top plan view of the right cushion insert of the second alternative embodiment.
Figure 26A:
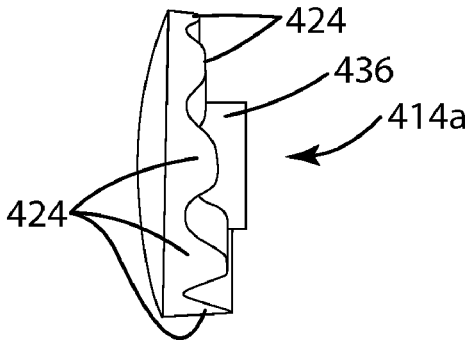
FIG. 26*a* is a right side elevational view of the right cushion insert of the second alternative embodiment.
Figure 25B:
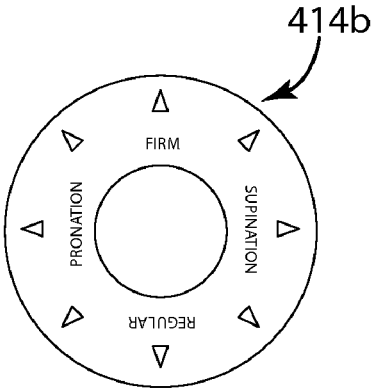
FIG. 25*b* is a top plan view of the left cushion insert of the second alternative embodiment.
Figure 26B:
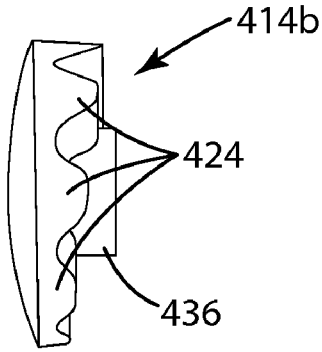
FIG. 26*b* is a right side elevational view of the left cushion insert of the second alternative embodiment.
Figure 27:
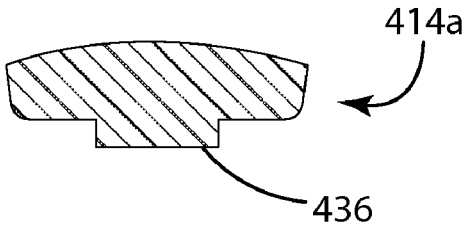
FIG. 27 is a sectional view of the right cushion insert taken along line XXVII-XXVII of FIG. 25*a*.

A second alternative sole construction 410 is shown in FIGS. 20-28. This embodiment is generally identical to the embodiment of FIGS. 12-17, except to the extent described. As shown, this embodiment includes a cushion insert 414 that is installed into the upper surface of the midsole 412. The cushion insert 414 differs from cushion insert 214 primarily in that it include a post 436 configured to be fitted into a corresponding alignment hole 444 in the midsole 412 (See FIGS. 23 and 27). If desired, the alignment hole 444 may extend entirely through the midsole 412 such that the post 436 is visible from the bottom of the midsole 412 as shown in FIG. 21. Alternatively, the alignment hole 444 may be replaced by a shallower hole (not shown) that extends into, but not through, the midsole 412. Right and left cushion inserts 414*a* and 414*b*, respectively, are shown in FIGS. 25*a-b* and 26*a-b*. As shown, the right and left cushion inserts 414*a* and 414*b* are essentially mirror images of each other. Referring now to FIGS. 22-24, the heel wedge 416, midsole 412, cushion insert 414 and sock liner 300 are assembled in essentially the same method as the alternative embodiment shown in FIGS. 12-17. FIG. 28 shows the sole construction installed in left and right articles of footwear. In this illustration, the cushion inserts 414*a* and 414*b* are installed in the "pronation" position.

Although the illustrated embodiments provide a broad range of adjustability, an even greater range may be provided by providing interchangeable sets of cushion inserts. For example, an article of footwear may be sold with two pairs of cushioning inserts, each pair having different cushioning (e.g. hardness) characteristics. For example, one set of inserts can have a durometer ranging between approximately 35-40 on the Asker C scale, while a second set of inserts can have a durometer ranging between approximately 30-40 on the Asker A scale. Other inserts can also be manufactured with different hardnesses without departing from the spirit of the present invention. The characteristics of the different pairs may be varied in essentially any way, such as by varying the thickness, shape or material of the different pairs. FIG. 11*b* is an illustration of a cushion insert 14' having greater thickness than cushion insert 14. In use, cushion insert 14' may be installed in place of cushion insert 14 to provide additional cushioning.

The above description is that of the current embodiment of the invention. Various alterations and changes can be made without departing from the spirit and broader aspects of the invention.

The embodiments of the invention in which an exclusive property or privilege is claimed are defined as follows:

1. A sole for footwear comprising:

a sole component including at least one receptacle; and an adjustable cushion insert fitted within said receptacle, said cushion insert capable of being rotated about an axis extending substantially perpendicular to a general extent of a bottom surface of said sole between at least two different orientations that provide the sole with different characteristics, whereby adjustment of said characteristics of the sole may be achieved by selectively fitting said cushion insert into said receptacle in a desired one of said orientations;

wherein said receptacle includes an interface surface and said cushion insert includes an interface surface interfacing with said receptacle interface surface, wherein a general extent of said receptacle interface surface and a general extent of said cushion insert interface surface are substantially parallel to the general extent of the bottom surface of said sole, wherein at least one of said receptacle interface surface and said cushion insert interface surface has projections extending therefrom for engaging the other of said receptacle interface surface and said cushion insert interface surface, wherein variations in said projections provide the sole with the different characteristics.

2. The sole of claim 1, wherein said sole component is further defined as at least one of an insole, a midsole, a heel wedge, and an outsole.

3. The sole of claim 1, wherein said receptacle is generally circularly shaped.

4. The sole of claim 1, wherein at least a portion of said interface surface of said receptacle is spaced from said interface surface of said cushion insert.

5. The sole of claim 1, wherein said cushion insert interface surface has projections matingly engaging said projections on said interface surface of said receptacle.

6. The sole of claim 5, wherein at least one of said projections varies in at least one of size, shape and hardness from at least one other of said projections.

7. The sole of claim 6, wherein said projections on said insert and on said receptacle are selected from the group consisting essentially of undulations, ridges, and lobes.

8. The sole of claim 5, further including a support layer disposed between said cushion insert interface surface and said receptacle interface surface.

9. The sole of claim 8, wherein said support layer is affixed to at least one of said cushion insert and said sole component.

10. The sole of claim 1 wherein said receptacle is formed within an upper surface of said sole component.

11. The sole of claim 1, wherein said cushion insert is generally disc shaped.

12. The sole of claim 1, wherein said receptacle further includes alignment means for aligning said cushion insert within said receptacle in both of said different orientations.

13. The sole of claim 12, wherein said alignment means includes an aperture in at least one of said cushion insert and said sole component and a post extending from the other of said cushion insert and said sole component, said post being fitted into said aperture to provide alignment of said cushion insert within said receptacle.

14. The sole of claim 1, wherein said receptacle is formed within the bottom surface of said sole component.

15. The sole of claim 1, wherein said sole component includes a heel region, said receptacle being located in said heel region.

16. The sole of claim 11, wherein at least one of said cushion insert projections and said receptacle projections includes a plurality of wave-like undulations extending about said axis.

17. The sole of claim 11, wherein at least one of said cushion insert projections and said sole component projections includes a plurality of wave-like undulations extending about said axis through regular angular sections.

18. A shoe comprising:

an upper;

a sole secured to said upper, said sole including a sole component and a cushion insert interfitted with said sole component, said cushion insert having a substantially vertical axis and being adjustable with respect to said sole component between at least first and second orientations, said cushion insert providing said sole with first characteristics when in said first orientation, said insert providing said sole with second characteristics different from said first characteristics when in said second orientation, whereby said sole is readily adjustable between said first characteristics and said second characteristics by rotation of said insert in a generally horizontal plane about said cushion insert axis with respect to said sole component;

wherein said sole component includes a receptacle for engagement with said cushion insert, said receptacle including an interface surface with a plurality of projections, said cushion insert including an interface surface with a plurality of projections matingly engaged with said plurality of projections in said receptacle interface surface;

wherein a general extent of said cushion insert interface surface and a general extent of said receptacle interface surface are substantially horizontal.

19. The shoe of claim 18, wherein at least a portion of said interface surface of said cushion insert is spaced from said interface surface of said receptacle.

20. The shoe of claim 19 wherein said receptacle includes an axis, said receptacle projections including a plurality of undulations extending about said axis through regular angular sections.

21. The shoe of claim 20 wherein said cushion insert projections include a plurality of undulations extending about said cushion insert axis.

22. The shoe of claim 21 wherein at least one of said cushion insert undulations varies in size, shape or hardness from at least one other of said cushion insert undulations, whereby rotation of said cushion insert within said receptacle about said axis results in variation of a characteristic of said sole.

23. The shoe of claim 22 wherein said cushion insert is movable with respect to said receptacle between at least a supination orientation and a pronation orientation.

24. The shoe of claim 22 wherein said cushion insert is movable with respect to said receptacle between at least a supination orientation to address problems associated with supination, a pronation orientation to address problems associated with pronation, a regular orientation and a firm orientation.

25. The shoe of claim 22 wherein said sole includes a support layer disposed between said cushion insert and said sole component, said support layer corresponding in shape with said cushion insert undulations and said receptacle undulations.

26. The shoe of claim 22 wherein said sole includes an aperture in at least one of said cushion insert and said sole component and a post extending from the other of said cushion insert and said sole component, said post being fitted into said aperture to provide alignment of said cushion insert within respect to said sole component.

27. A sole assembly comprising:

a midsole defining a cavity, said cavity having an interface surface with a cavity axis and a plurality of waves undulating through regular angular sections about said cavity axis;

a cushion insert fitted into said cavity, said cushion insert being generally disc-shaped and having a cushion insert axis, said cushion insert having an interface surface engaging said interface surface of said cavity, said interface surface of said cushion insert having a plurality of waves undulating about said cushion insert axis through regular angular sections, said cushion insert waves mating with said cavity waves, said cushion insert being rotatable about said cavity axis and said cushion insert axis to selectively vary which of said cavity waves and said cushion insert waves mate with each other, at least one of said cavity waves and said cushion insert waves varying from at least one other of said cavity waves and said cushion insert waves, whereby rotation of said cushion insert within said cavity results in variation in a characteristic of the sole assembly;

wherein the cushion insert interface surface waves undulate in a direction substantially parallel to said cushion insert axis and the cavity interface surface waves undulate in a direction substantially parallel to said cavity axis.

* * * * *